US006056244A

United States Patent [19]

Durchschlag et al.

[11] Patent Number: 6,056,244

[45] **Date of Patent: *May 2, 2000**

[54] RAILWAY SWITCH SETTING DEVICE

[75] Inventors: Gerald Durchschlag, deceased, late of Zeltweg, by Brigitte Durchschlag, legal representative; Herbert Achleitner, Graz, both of Austria

[73] Assignee: Vae Aktiengesellschaft, Austria

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/945,292

[22] PCT Filed: May 2, 1996

[86] PCT No.: PCT/AT96/00087

§ 371 Date: Feb. 9, 1998

§ 102(e) Date: Feb. 9, 1998

[87] PCT Pub. No.: WO96/34786

PCT Pub. Date: Nov. 7, 1996

[30] Foreign Application Priority Data

May 3, 1995 [AT] Austria ..... 759/95

[51] Int. Cl.[7] ..... B61L 5/00

[52] U.S. Cl. ..... 246/257; 246/258; 246/262; 246/415 R; 246/430

[58] Field of Search ..... 246/257, 258, 246/262, 263, 415 R, 430, 435 R

[56] References Cited

U.S. PATENT DOCUMENTS

| | | | |
|---|---|---|---|
| 5,292,091 | 3/1994 | Callegari et al. | 246/258 |
| 5,417,392 | 5/1995 | Wyatt | 246/257 |
| 5,687,935 | 11/1997 | Durchschlag et al. | 246/257 |

FOREIGN PATENT DOCUMENTS

| | | | |
|---|---|---|---|
| 480 303 | 4/1992 | European Pat. Off. . | |
| 480303A2 | 4/1992 | European Pat. Off. | 246/258 |
| 1 910 070 | 6/1971 | Germany . | |
| 1910070 | 6/1971 | Germany | 246/258 |
| 2 144 564 | 3/1973 | Germany . | |
| 520 009 | 3/1972 | Switzerland . | |
| 96/00160 | 1/1996 | WIPO . | |

*Primary Examiner*—S. Joseph Morano
*Assistant Examiner*—Robert J. McCarry, Jr.
*Attorney, Agent, or Firm*—Pillsbury Madison & Sutro LLP

[57] ABSTRACT

A device for setting railway switches includes a plurality of interlinked hydraulic switching devices (6) connected to a separate reversible hydraulic drive unit in a manner offset in the longitudinal direction of the rails, wherein the working volumes of the hydraulic cylinder piston aggregates (6) are connected to driving movement in same direction. The pistons (20) or plungers (11) include push-open valves (18) for travel limitation.

19 Claims, 6 Drawing Sheets

RAILWAY SWITCH SETTING DEVICE

BACKGROUND OF THE INVENTION

1. Field of the Invention

The invention relates to a device for setting railway switches, comprising a plurality of interlinked hydraulic cylinder piston aggregates connected in parallel or in series, which are arranged to be offset in the longitudinal direction of the rail and are connected with a hydraulic drive unit. In such railway switch setting devices it is known to realize the connection of the individual locks by means of a mechanical rod assembly. Yet, such a mechanical connection of a plurality of setting devices or locks, respectively, requires relatively much space as well as a great number of individual parts differing from one another. In addition to the elevated demand of space, such a mechanical connection affects the packability of the tongue means, an unfavorable unilateral distribution of mass being, moreover, caused on a railway switch.

2. Prior Art

From EP-A2 480 303 a hydraulic switching device in which a plurality of individual actuating cylinders is controlled by a hydraulic station has already been known. From DE-B2 1952823 different circuit arrangements for the series connection or parallel connection of a plurality of such hydraulic switching devices are known.

SUMMARY OF THE INVENTION

The invention aims at providing a device of the initially defined kind, which may subsequently be installed in existing railway switch setting devices in a simple manner and with which expenditures for an accordingly complex control may be obviated. The invention, in particular, aims at safeguarding a high degree of reliability and unsusceptibility to failures despite its simple mode of construction requiring but few different structural components. Above all, it is to be feasible according to the invention that the respectively desired displacement position be safely obtained even at slight fluid losses and without complex volumetric control of the hydraulic drive. Finally, the device according to the invention is to be readily applicable as a substitute for mechanical means of known construction in order to enhance the packability of the tongue means and avoid unilateral mass distribution on the railway switch.

To solve this object, the invention essentially consists in that the hydraulic cylinder piston aggregates each contain a floating piston or plunger guided between two working volumes and that the floating pistons or plungers cooperate with push-open valves within their displacement path. The selection of different adjustment positions along the rail path is obtained by means of this connection capable of being locked or through-connected by the push-open valves. Said connection is opened or interrupted as a function of the position of the piston or plunger. At an interruption of the connection the set position of the switching device is exactly reached. Besides its compact construction, such a hydraulic switching device comprising a floating piston or plunger, thus, in a simple manner also provides for adaptation to the respectively desired requirements. By means of a separate, advantageously reversible, hydraulic drive unit fluid is displaced into the working volumes of identically constructed cylinder piston aggregates during each setting procedure so as to immediately ensure coupling with neighboring cylinder piston aggregates. On the whole, such a device comprising cylinder piston aggregates of identical design may be realized by a particularly simple construction, wherein suitable hydraulic conduits are to be provided for connection between neighboring cylinder piston aggregates. Interconnection is each effected in a manner to cause the displacement of neighboring cylinder piston aggregates in same direction as medium is pressed out of the hydraulic drive unit. In a particularly simple manner, the configuration according to the invention is further developed in a manner that the push-open valves are arranged in a bore of the piston or plunger, that connects the two working volumes, wherein the end or ring surfaces of the pistons or plungers respectively immersing into the oppositely located working volumes may have identical cross sectional areas. Such a floating piston or plunger constitutes a structurally most simple, operationally safe and compact construction capable of being placed on the respectively desired point without requiring much space. There may be provided a plurality of identical cylinder piston aggregates of this type, the basic advantage residing in identical cross sectional areas each being powered with pressure fluid, thus giving rise to a synchronous movement. The selection of different adjustment positions along the rail path is obtained by means of this connection capable of being locked or through-connected by the push-open valves. Said connection is opened or interrupted as a function of the position of the piston or plunger. At an interruption of the connection the set position of the switching device is exactly reached. Besides its compact construction, such a hydraulic switching device comprising a floating piston or plunger, thus, in a simple manner also provides for adaptation to the respectively desired requirements.

To couple the hydraulic switching devices with the mechanical switching devices, the configuration advantageously may be devised such that the piston or plunger of the pumping element comprises a bearing, in particular a link block including an annular groove, or a bearing eye between its free ends and that the bearing is arranged to project from an aperture of the cylinder or between two stationarily fixed cylinders. Again, a particularly simple, operationally safe and compact configuration readily suitable also for subsequent installation is feasible.

Instead of the initially mentioned plungers or floating pistons, the ring surface of a piston may each guarantee the required identical working cross section in both directions of displacement, as already pointed out above. A particularly simple structure is obtained in that the piston is rigidly connected with a throughgoing piston rod sealingly passing through the cylinders and that the piston rod or the cylinder is stationarily fixed.

In order to ensure a high degree of operating safety, the overall system advantageously is adjusted to a predetermined overpressure, based on atmospheric pressure. In this way, temperature fluctuations, which might lead to pressure changes, can be buffered, to which end the configuration advantageously is devised such that the working volumes of the cylinder piston aggregates are connected with a pressure reservoir via pressure control valves. In a particularly simple manner, the pressure control valves are designed as nonreturn valves capable of being controlledly opened, such nonreturn valves capable of being controlledly opened yielding a high degree of operating safety. At high operating temperatures, medium is pressed out into the pressure reservoir by controlledly opening the nonreturn valves, whereas pressure may again be made available to the system via the nonreturn valves at a pressure decrease. In order to safeguard, in such a configuration, that the operating safety continues to be guaranteed by appropriate warning if a leakage has occurred in the conduit system, the configuration in a particularly simple manner may be devised such that a pressure-controlled directional control valve is each connected to the pump working volumes, which assumes its closed position upon falling short of a predetermined pressure, thus ensuring that all of the switching devices are blocked in such a case. Blocking of the switching devices will be signalized on the respective site by the mechanical switching actuator and the pertaining control means for the mechanical switching actuator, so that repair of the damage may be arranged for at once.

BRIEF DESCRIPTION OF THE DRAWINGS

In the following, the invention will be explained in more detail by way of exemplary embodiments schematically illustrated in the drawing. Therein.

DETAILED DESCRIPTION OF PREFERRED EMBODIMENTS OF THE INVENTION

Figure 1:
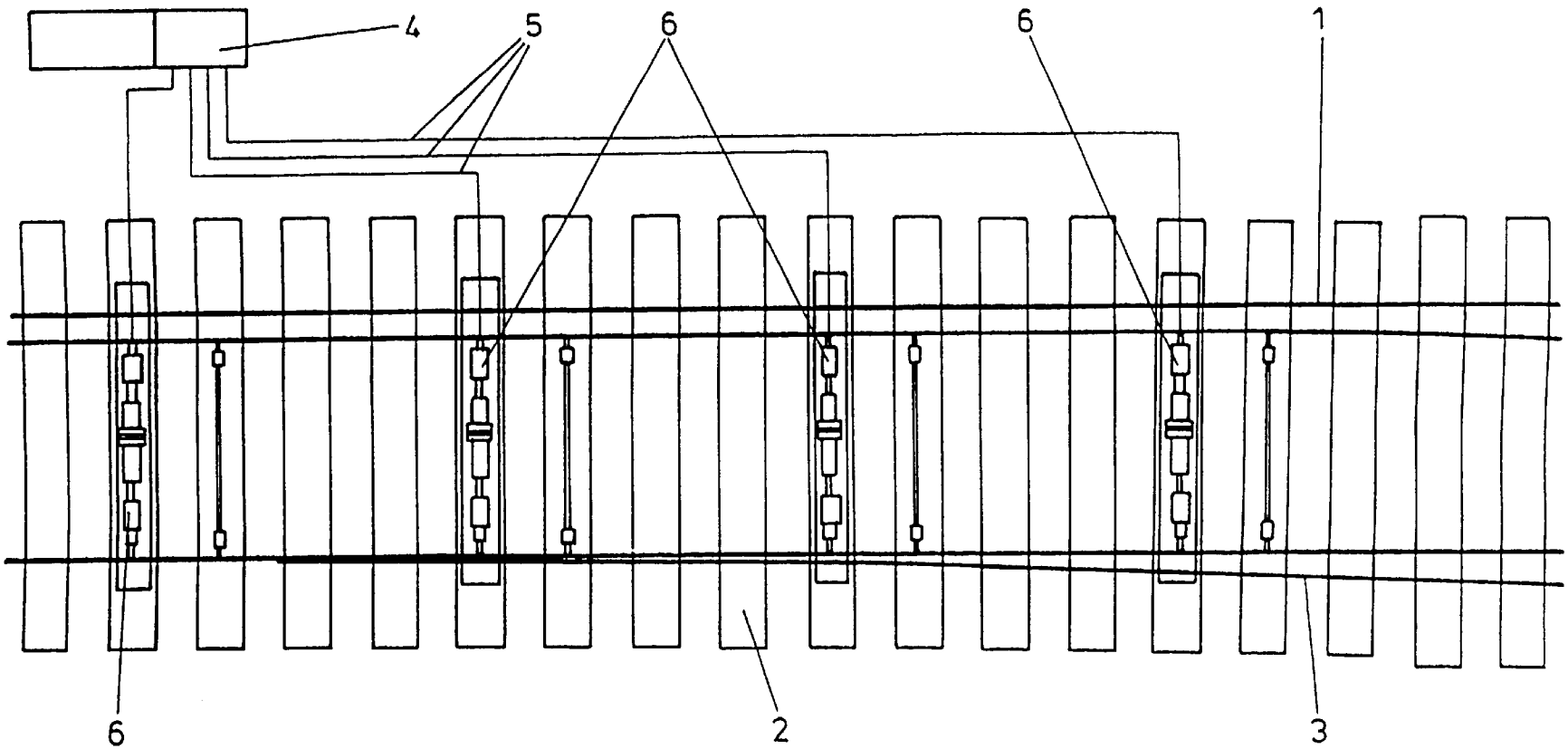
FIG. 1 is a top view on a partial region of a railway switch.
Figure 2:
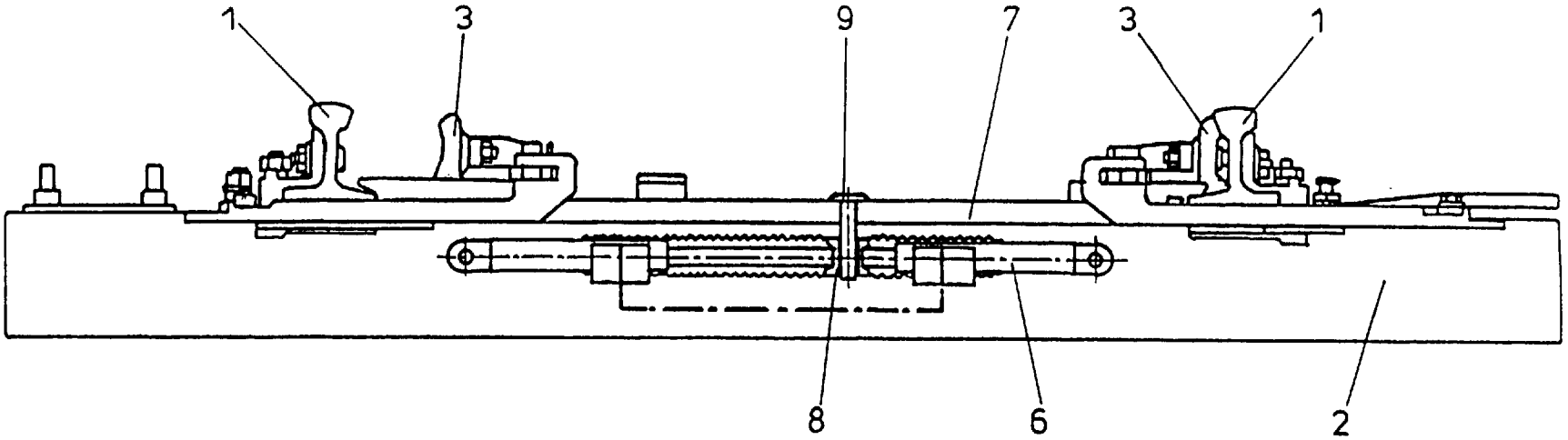
FIG. 2 depicts a detail of the connection of a cylinder piston aggregate with a mechanical push rod.
Figure 3:
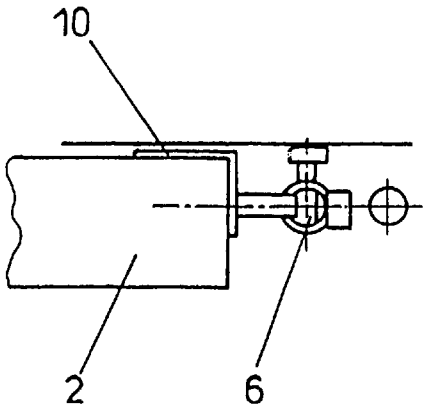
FIG. 3 is a schematic partial view of the illustration according to FIG. 2.

In FIG. 1, rails 1 are schematically indicated, which are connected with sleepers 2. In the region of a railway switch, tongue rails 3 are provided in addition to the standard rails 1, which tongue rails may be brought into their respective positions by a separate reversible hydraulic drive unit schematically indicated by 4. The hydraulic drive unit 4 acts on the tongue rails 3 via a hydraulic rod assembly 5 and the hydraulic cylinder piston aggregates 6. There are several hydraulic cylinder piston aggregates 6 apparent in the rail course, which are coupled with one another. From the representation of FIG. 2, the hydraulic cylinder piston aggregates 6, together with the push rods 7, are more clearly apparent. The cylinder piston aggregates 6 each comprise a link block 8, in which a pin 9 of the push rod 7 is inserted. Upon actuation of the push rod 7, the link block and hence the piston of the hydraulic cylinder piston aggregate are displaced, thus pressing fluid out of the respective working volume. FIG. 3 illustrates the type of fixation of the hydraulic cylinder piston aggregate 6 to the sleeper 2. Fixation is effected via a fastening plate 10 fixed to the sleeper 2. The hydraulic cylinder piston aggregates 6 require relatively little space so as to have no effect on the packing of the substructure.

Figure 4:
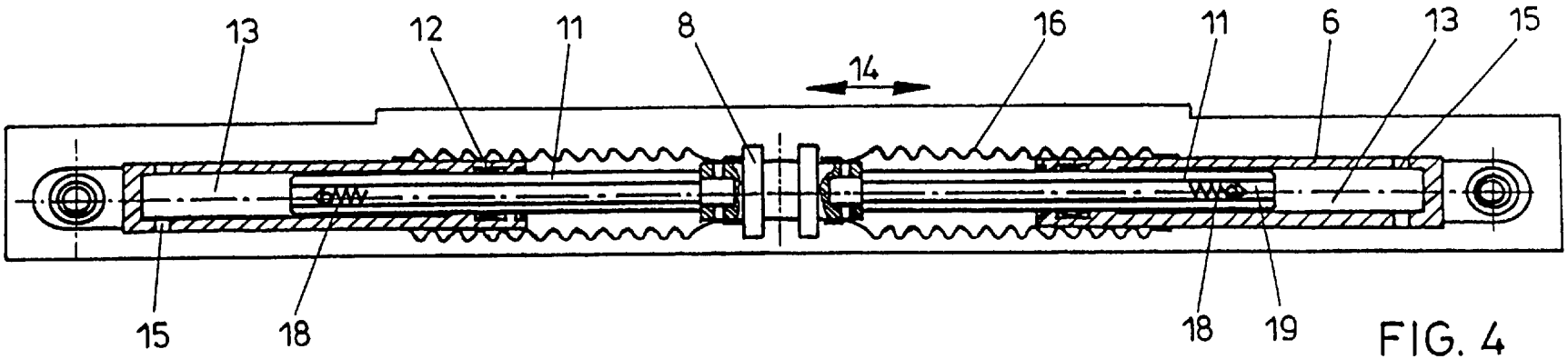
FIG. 4 is a partially sectioned enlarged representation of the hydraulic cylinder piston aggregate.
Figure 5:
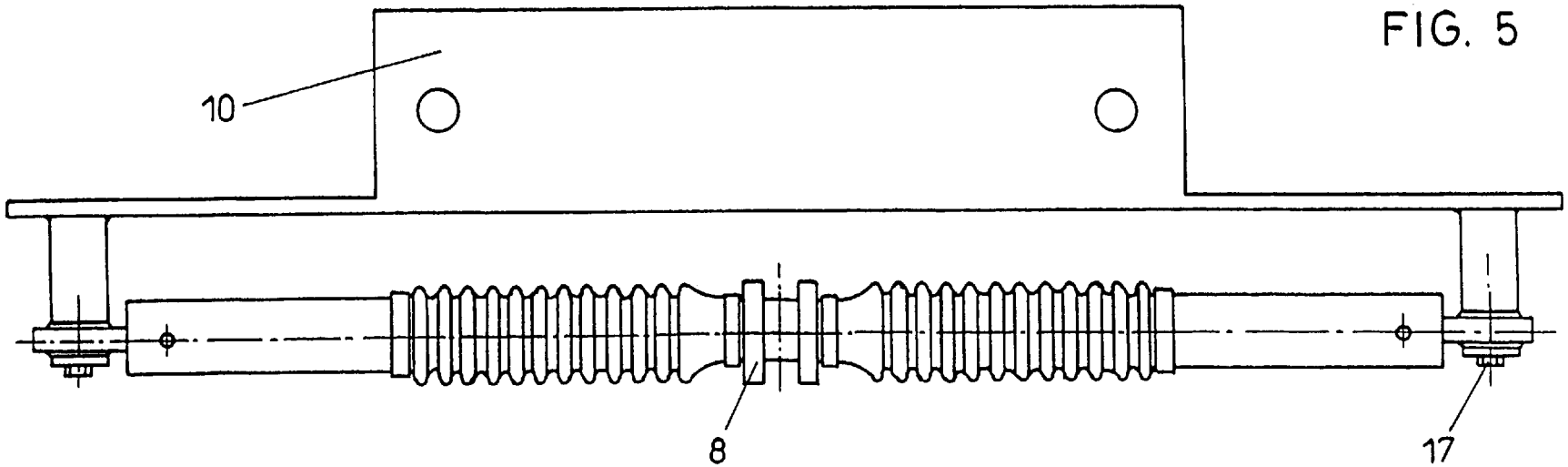
FIG. 5 is a top view on the illustration according to FIG. 4.

The mode of functioning of the hydraulic cylinder piston aggregates and their preferred configuration are explained in more detail by way of FIGS. 4 and 5. In FIGS. 4 and 5, a hydraulic cylinder piston aggregate 6 comprising plungers 11 is to be seen. The plungers 11 plunge into the respective working volumes 13 of the hydraulic cylinder piston aggregates via seals 12 and, upon displacement of the plunger 11 in one of the directions of the double arrow 14, medium is each pressed out of the respective working volume 13. The hydraulic connections lead to the externally provided apertures 15 in the respective working volume 13. The link block, via which mechanical coupling is effected, is again denoted by 8. Furthermore, a rubber sleeve 16 is provided for protecting the device.

FIG. 5 depicts the device according to FIG. 4 in top view. As is also apparent from the illustration according to FIG. 4, equal cross sections are each effective on both sides in such a configuration of the hydraulic cylinder piston aggregate. Fixation of the cylinders of the hydraulic cylinder piston aggregate is effected to the angle plate 10 via pins 17.

Figure 6:
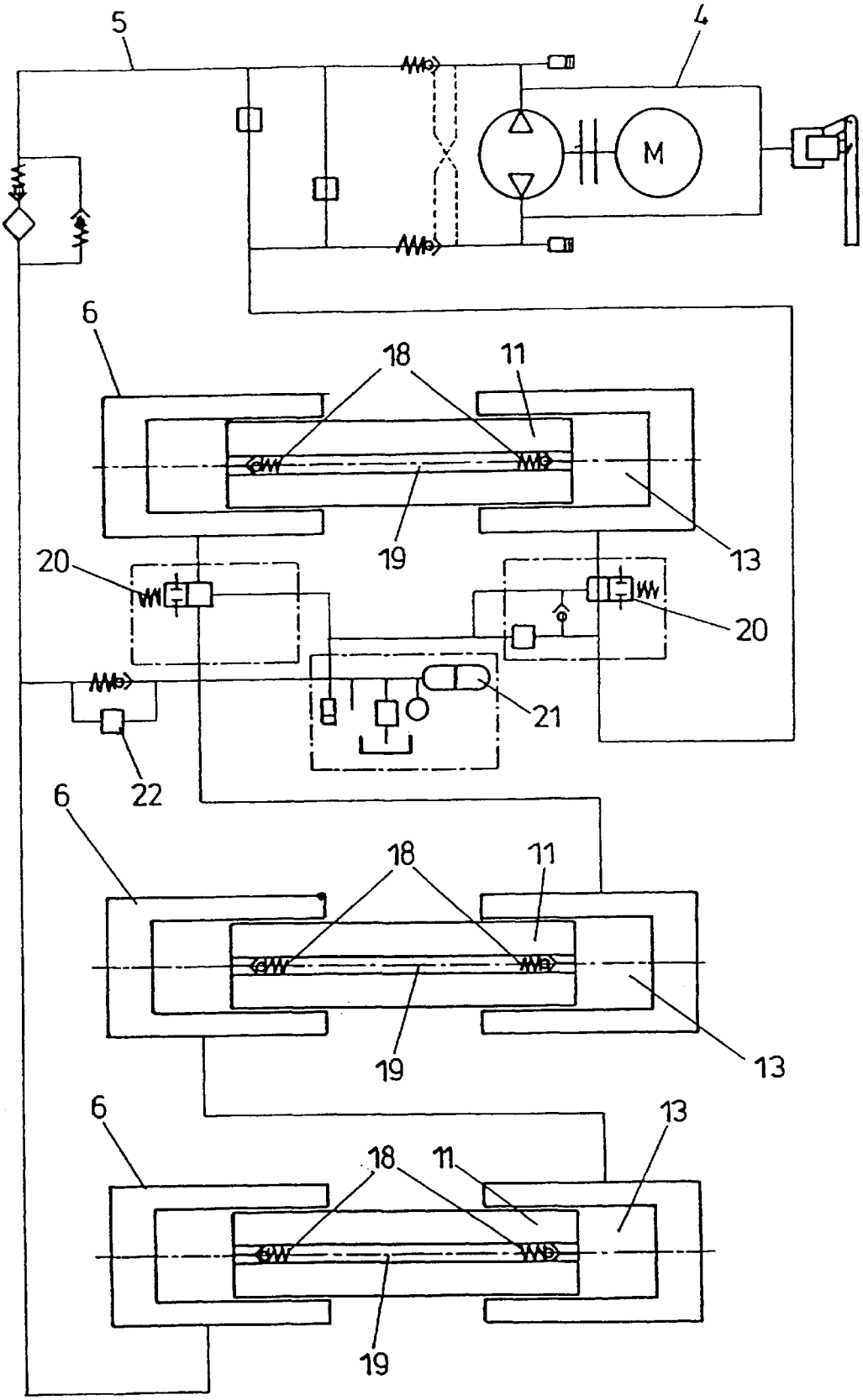
FIG. 6 is a schematic illustration of the hydraulic connection of the individual cylinder piston aggregates.

As is apparent from FIG. 6, the working volumes 13 are connected with one another and with a separate hydraulic drive unit 4 via hydraulic conduits 5, e.g., in parallel with the hydraulic drive unit 4, the connection being effected in a controlled manner with a view to ensuring that, with the displacement of the first hydraulic cylinder piston aggregate, all other hydraulic cylinder piston aggregates 6 are coupled to displacement in same direction. If hydraulic cylinder piston aggregates arranged in parallel or in series are to cover a distance that differs from the travel of the hydraulic cylinder piston aggregate used as the pumping element, push-open valves 18 provided in bores 19 must be set accordingly. The hydraulic conduits 5 contain a number of valves in order to keep the pressure constant under operating conditions and in order to be able to safely detect inadmissible situations. In detail, a spring-biased valve 20 is provided, which is actuated by the hydraulic pressure prevailing in the conduits 5. If the pressure in the hydraulic conduits 5 falls below a limit value, the force of the spring of the spring-biassed valve 20 will move the spring-biased valve 20 into the closed position so as to prevent further displacement of the hydraulic cylinder piston aggregate 6. In that case, the switching actuator is blocked and a respective fault message is delivered.

Furthermore, a pressure reservoir 21 is provided, which is connected with the respective hydraulic conduits 5 via overflow valves or nonreturn valves 22. The overflow valves or nonreturn valves are controlled in a manner that fluid is pressed into the reservoir 21 at a pressure increase on account of thermal expansion and, vice versa, fluid is pressed back into the conduits 5 from the hydraulic reservoir 21 at a slight pressure decrease. The spring-biased safety valves 20 enter into effect only at a leakage and a respective pressure decrease also in the reservoir 21.

Figure 7:
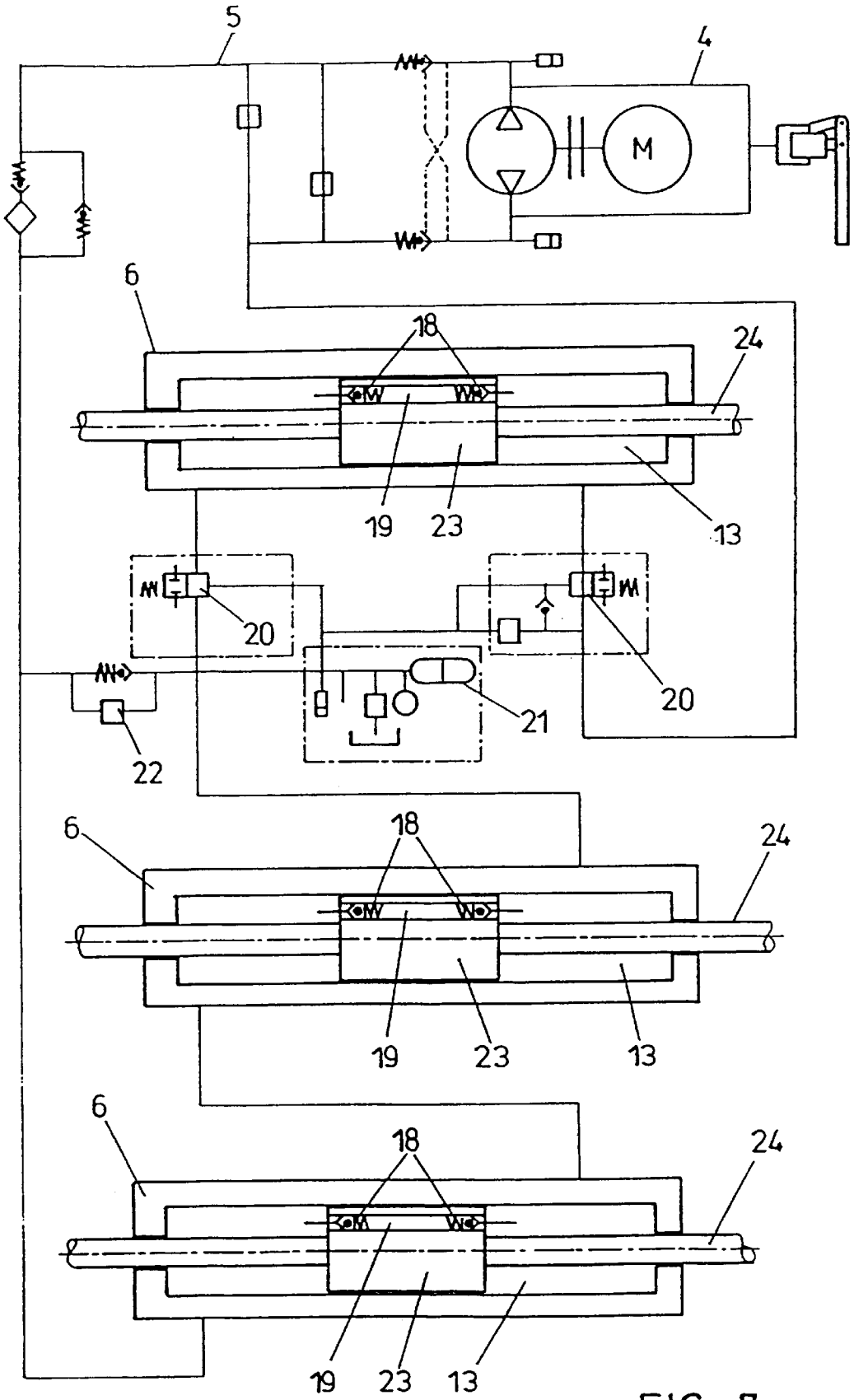
FIG. 7 shows an alternative configuration of cylinder piston aggregates for the device according to the invention.

From FIG. 7, another modified configuration of the hydraulic cylinder piston aggregates is apparent. With a view to feeding fluid to identical work surfaces, the configuration again is devised such that equal cross sections of a piston each enter into effect in the two working volumes 13. The piston 23 is connected with a piston rod 24 and in the instant case each of the ring surfaces becomes active or is actuated. As for the rest, this configuration comprises the same structural components as the configuration according to FIG. 6, the same reference numerals having again been used.

Figure 8:
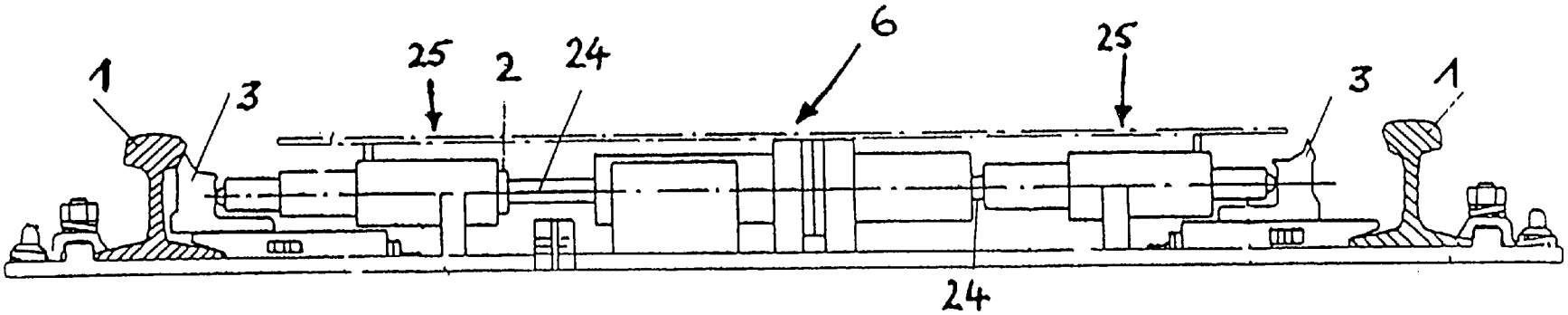
FIG. 8 is a schematic view of the configuration according to FIG. 7 installed in a railway switch.

FIG. 8 depicts locks arranged coaxial with the drive according to FIG. 7. The hydraulic cylinder piston aggregate of the actuator is again denoted by 6, and 25 serves to denote the respective separate lock for every set position.

What is claimed is:

1. A device for setting a railway switch to position rail, comprising a plurality of interlinked hydraulic piston aggregates disposed in offset relationship with one another in a longitudinal direction of the rail, said aggregates being connected with a hydraulic drive unit, wherein each of the aggregates includes a movable piston which is guided for movement in a displacement path within a fixed cylinder and which is positioned between two fluid working volumes within the cylinder, said piston being associated with a mechanically operated push-open valve disposed in said displacement path.

2. A device according to claim 1, wherein said push-open valve is positioned within a base of the piston that connects the two working volumes.

3. A device according to claim 1 or 2, wherein the piston is associated with a link block which projects from the cylinder and which is connected to the rail.

4. A device according to claim 2, wherein the piston is rigidly connected to a piston rod which passes through a seal in the cylinder.

5. A device according to claim 1 or 2, wherein the working volumes of the aggregates are connected to a pressure reservoir.

6. A device according to claim 3, wherein the working volumes of the aggregates are connected to a pressure reservoir.

7. A device according to claim 4, wherein the working volumes of the aggregates are connected to a pressure reservoir.

8. A device according to claim 5, wherein the pressure control valves are controllably opened.

9. A device according to claim 6, wherein the pressure control valves are controllably opened.

10. A device according to claim 7, wherein the pressure control valves are controllably opened.

11. A device according to claim 1 or 2, wherein each working volume is connected to a pressure-controlled directional control valve which assumes a closed position below a predetermined pressure.

12. A device according to claim 3, wherein each working volume is connected to a pressure-controlled directional control valve which assumes a closed position below a predetermined pressure.

13. A device according to claim 4, wherein each working volume is connected to a pressure-controlled directional control valve which assumes a closed position below a predetermined pressure.

14. A device according to claim 5, wherein each working volume is connected to a pressure-controlled directional control valve which assumes a closed position below a predetermined pressure.

15. A device according to claim 6, wherein each working volume is connected to a pressure-controlled directional control valve which assumes a closed position below a predetermined pressure.

16. A device according to claim 7, wherein each working volume is connected to a pressure-controlled directional control valve which assumes a closed position below a predetermined pressure.

17. A device according to claim 8, wherein each working volume is connected to a pressure-controlled directional control valve which assumes a closed position below a predetermined pressure.

18. A device according to claim 9, wherein each working volume is connected to a pressure-controlled directional control valve which assumes a closed position below a predetermined pressure.

19. A device according to claim 10, wherein each working volume is connected to a pressure-controlled directional control valve which assumes a closed position below a predetermined pressure.

* * * * *